United States Patent [19]

König et al.

[11] Patent Number: 4,701,974

[45] Date of Patent: Oct. 27, 1987

[54] CABLE COIL HOLDING ASSEMBLY IN A VACUUM CLEANER

[75] Inventors: Gerhard König, Bad-Neustadt; Karl Fleck, Ostheim; Herbert Kess, Bad-Neustadt; Artur Weigand, Niederlauer, all of Fed. Rep. of Germany

[73] Assignee: Siemens Aktiengesellschaft, Munich, Fed. Rep. of Germany

[21] Appl. No.: 924,700

[22] Filed: Oct. 29, 1986

[30] Foreign Application Priority Data

Nov. 15, 1985 [DE] Fed. Rep. of Germany ... 8532395[U]

[51] Int. Cl.[4] ..... A47L 9/26

[52] U.S. Cl. ..... 15/323; 15/327 F; 15/413

[58] Field of Search ..... 15/323, 412, 413, 327 F

[56] References Cited

FOREIGN PATENT DOCUMENTS

| | | | |
|---|---|---|---|
| 616857 | 4/1932 | Fed. Rep. of Germany . | |
| 2124790 | 3/1972 | Fed. Rep. of Germany . | |
| 2724249 | 11/1978 | Fed. Rep. of Germany | 15/323 |
| 2256744 | 8/1975 | France . | |
| 57858 | 7/1946 | Netherlands | 15/323 |

*Primary Examiner*—Chris K. Moore

*Attorney, Agent, or Firm*—Kenyon & Kenyon

[57] ABSTRACT

A cable coil support assembly installable in an appropriate seating space of a vacuum cleaner comprises a cable drum having a hollow hub rotatably supported on a bearing pin axially projecting from a fixed supporting wall of the assembly. The hub is provided with radially oriented openings in communication with a suction space of the vacuum cleaner, whereby cooling air is drawn between adjacent winding of an electrical cable on the cable drum. The supporting wall is provided with at least one opening enabling gaseous communication between the cavity in the hub and the suction space of the vacuum cleaner.

13 Claims, 1 Drawing Figure

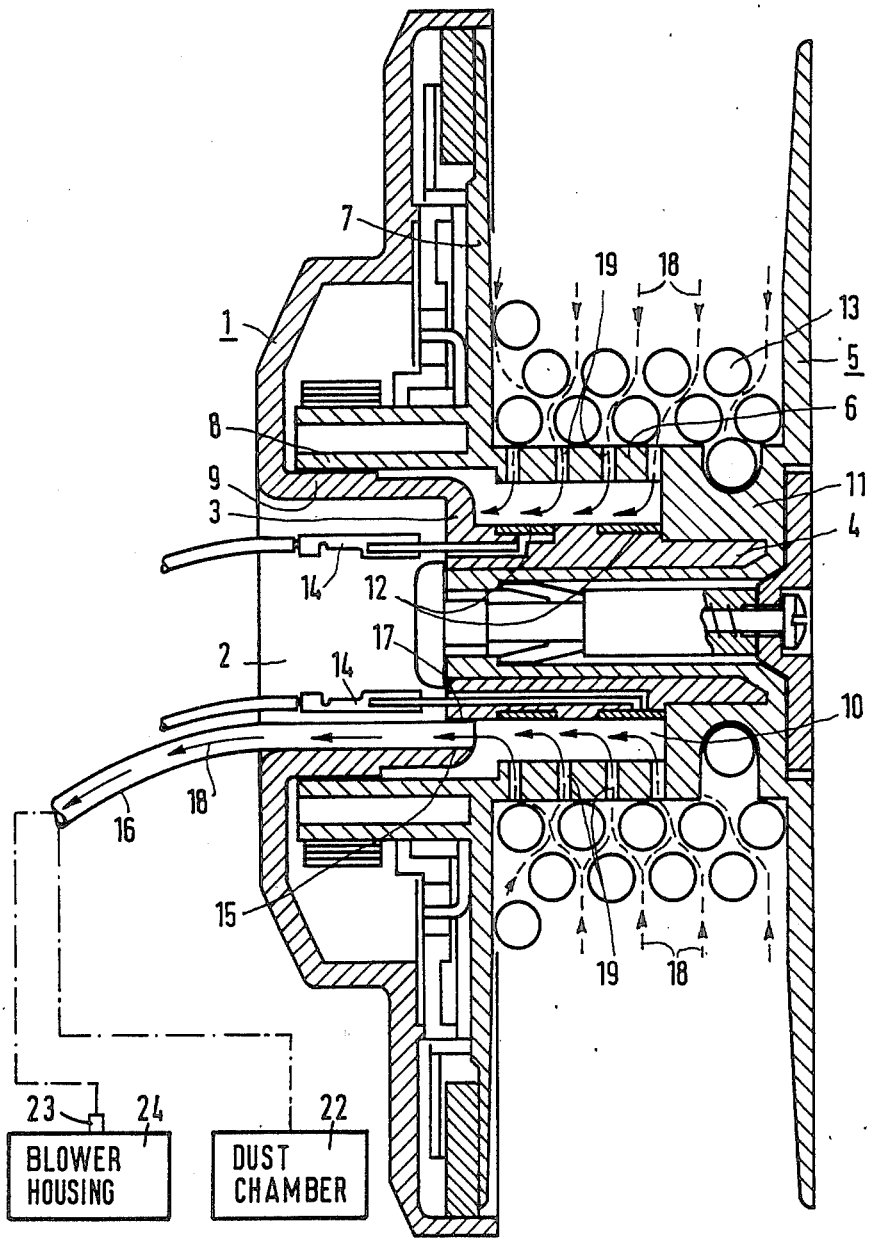
7
19
18
13
1
5
6
8
9
11
3
4
14
12
17
2
14
10
18
16
15
19
18
23
24
22
BLOWER HOUSING
DUST CHAMBER

CABLE COIL HOLDING ASSEMBLY IN A VACUUM CLEANER

BACKGROUND OF THE INVENTION

This invention relates to a cable coil holding assembly in a vacuum cleaner.

Such a cable coil holding or winding assembly is generally installed in an appropriate seating space of a vacuum cleaner and includes a cable drum having a hollow hub mounted on a bearing pin projecting axially from a fixed supporting wall in the vacuum cleaner. During operation of the vacuum cleaner, a portion of the connecting cord usually remains on the cable drum. Inasmuch as the individual turns of the cable are closely juxtaposed to each other on the cable drum, the round-up portion of the electrical cord is heated to a great extent by the operating current of the vacuum cleaner.

As disclosed in German Patent Document (Offenlegungsschrift) No. 27 24 249 a vacuum cleaner blower may be disposed so as to pull a cooling air stream through the seating space of the cable coil holding assembly in order to limit the temperature to which the cable is heated.

It has been discovered such a cooling of the seating space of the holding assembly is sometimes inadequate to maintain the temperature of the electrical cable within a desired temperature range. This result arises especially when the operating current of the vacuum cleaner is higher than usual, either due to a very high capacity blower or to an operating voltage lower than 200 volts, e.g., 110 volts.

An object of the present invention is to provide an improved cable coil holding assembly of the above-described type.

Another object of the present invention is to provide such an improved cable coil holding assembly wherein an enhanced cooling of the wound portion of a vacuum cleaner electrical cable is achieved without requiring a great amount of cooling air to effectuate the cooling.

SUMMARY OF THE INVENTION

A cable coil holding assembly in a vacuum cleaner comprises in accordance with the present invention, a support wall formed with a cup-shaped indentation, a bearing pin rigid with the indentation and projecting substantially perpendicularly therefrom, and a cable drum having a pair of side walls attached to a hollow hub. The hub defines a cavity an the bearing pin extends axially thereinto. The cable drum is provided with an annular flange extending axially from one of the side walls. The flange of the cable drum engages an outer surface of the indentation of the supporting wall to form a support bearing for the drum. The hub is provided with radial openings, while the indentation is provided with an aperture communicating with the openings via the cavity in the hub. A conduit in the vacuum cleaner connects the aperture in the supporting wall indentation to a suction space of the vacuum cleaner.

In a vacuum cleaner in accordance with the present invention, the air stream for cooling the wound portion of the electrical cable is conducted directly through the cable turns wound on the cable drum. With such a cooling technique, an adequate cooling of the wound portion of the electrical cable is achieved with a relatively small amount of cooling air, excess heating of the electrical cable thereby being easily and efficiently prevented.

In accordance with a particular feature of the present invention, the bearing pin has a diameter smaller than an outside diameter of the indentation in the supporting wall so that the indentation has at one end a transversely oriented annular surface surrounding an end of the bearing pin. The aperture in the indentation is provided preferably in the annular surface thereof.

Pursuant to another feature of the present invention the hub is provided on a radially inner side and at an end opposite the flange with an inwardly projecting annular shoulder engaging the bearing pin. The shoulder and the pin cooperate with one another to form another bearing support for the drum.

The cavity in the hub is advantageously sealed at the opposite ends. This sealing is achieved preferably by the two support bearings for the cable drum.

The conduit in the vacuum cleaner advantageously takes the form of a hollow line or tube molded to the supporting wall. The hollow line or tube may be connected to a nipple provided on an suction side of a blower housing of the vacuum cleaner or may be connected to a dust chamber of the vacuum cleaner.

BRIEF DESCRIPTION OF THE DRAWING

The sole FIGURE of the drawing comprises a partially schematic longitudinal cross-sectional view through a cable coil support or holding assembly in a vacuum cleaner.

DETAILED DESCRIPTION

As illustrated in the drawing, a fixed supporting wall 1 in a vacuum cleaner is provided with a cup-shaped indentation 2 having a bottom wall 3 to which a bearing pin 4 is integrally molded. A cable drum 5 has a hollow hub 6 about which an electrical cable 13 is partially wound during operation of the vacuum cleaner (not illustrated). The cable drum includes two substantially annular sidewalls 7 and 21 attached along their inner peripheries to opposite ends of hub 6.

Hub 6 of drum 5 is provided on one side with an axial extension in the form of an annular flange 8. Annular flange 8 engages a cylindrical outer surface 9 of cup-shaped indentation 2 to form a first bearing for cable drum 5. A second bearing is formed by an annular shoulder 11 and an outer end of bearing pin 4. Shoulder 11 is integral with hub 6 of cable drum 5 at and end thereof opposite flange 8 and projects inwardly towards bearing pin 4.

Hub 6 defines a substantially cylindrical cavity 10 closed at one end by flange 8 and outer surface 9 of cup-shaped indentation 2 and at an opposite end by shoulder 11 and bearing pin 4. Bearing pin 4 is provided in the area of cavity 10 with a plurality of slip rings 12 engaged by brush or wiper contact members (not illustrated) in conductive connection with electrical cable 13. Slip rings 12 are coupled to a power source via leads 14.

Bearing pin 4 has an outer diameter smaller than an outer diameter of bottom wall 3 of cup-shaped indentation 2, whereby bottom wall 3 takes the form, at least in part, of a transversely oriented annular surface surrounding the inner end of bearing pin 4. An aperture 15 is advantageously disposed in annular bottom wall 3 and connected to an inner end 17 of a hollow line or hose 16, the other end of hose 16 being connected to a suction space of the vacuum cleaner. This suction space to which hose 16 is connected may be exemplarily a dust chamber 22 of the vacuum cleaner. Alternatively, hose 16 may be connected to a suction nipple 23 provided on the blower housing 24 of the vacuum cleaner.

As indicated by arrows 18, a cooling air stream generated by the vacuum cleaner's blower flows between adjacent windings of electrical cable 13, through radially oriented openings 19 in hub 6, through cavity 10 and opening 15 into tube 16. The flow of cooling air across the individual windings of electrical cable 13 on cable drum 5 results in an enhanced cooling of the wound portion of the electrical cable. The power required to perform the cooling function is relatively small. Cavity 10 is sufficiently sealed by the two bearing points so that air aspirated through hose 16 is sucked into cavity 10 through openings 19 substantially exclusively.

Tube 16 is advantageously molded to supporting wall 1. The cable winding or holding assembly can then be installed in a vacuum cleaner housing so that the free end of tube 16 is in vacuum communication with dust chamber 22 of the vacuum cleaner. This ease of assembly obviates separate assembly operations to install and connect hollow line or tube 16.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawing and description herein are proffered by way of example to facilitate comprehension of the invention and should not be construed to limit the scope thereof.

What is claimed is:

1. In a vacuum cleaner, a cable holding assembly for supporting an electrical cable in a wound configuration, said assembly comprising:

a supporting wall in the vacuum cleaner, said supporting wall being formed with a cup-shaped indentation;

a bearing pin rigid with said indentation and projecting substantially perpendicularly therefrom;

a cable drum having a pair of sidewalls attached to a hollow hub and an annular flange extending axially from one of said sidewalls, said hub defining a cavity, said pin extending axially into said cavity, said flange engaging an outer surface of said indentation to form a support bearing therewith for said drum, said hub being provided with radial openings, said indentation being provided with an aperture communicating with said openings via said cavity; and conduit means in the vacuum cleaner for connecting said aperture to a suction space of the vacuum cleaner.

2. A cable holding assembly as set forth in claim 1 wherein said bearing pin has a diameter smaller than an outside diameter of said indentation so that said indentation has at one end a transversely oriented annular surface surrounding an end of said bearing pin, said aperture being provided in said annular surface.

3. A cable holding assembly as set forth in claim 2 wherein said hub is provided on a radially inner side at an end opposite said flange with an inwardly projecting annular bearing shoulder engaging said pin, said shoulder and said pin cooperating to form another support bearing for said drum.

4. A cable holding assembly as set forth in claim 2, further comprising sealing means for sealing said cavity at opposite ends thereof, said sealing means including at an end opposite said flange an inwardly projecting annular bearing shoulder engaging said pin, said shoulder and said pin cooperating to form for said drum a support bearing sealing the end of said cavity opposite said flange.

5. A cable holding assembly as set forth in claim 2 wherein said conduit means includes a hollow line connected to a nipple provided on a suction side of a blower housing of the vacuum cleaner.

6. A cable holding assembly as set forth in claim 2 wherein said conduit means includes a hollow line connected to a dust chamber of the vacuum cleaner.

7. A cable holding assembly as set forth in claim 2 wherein said conduit means includes a hollow line in the form of a tube molded to said supporting wall.

8. A cable holding assembly as set forth in claim 1, further comprising sealing means for sealing said cavity at opposite ends thereof, said sealing means including at an end opposite said flange an inwardly projecting annular bearing shoulder engaging said pin, said shoulder and said pin cooperating to form for said drum a support bearing sealing the end of said cavity opposite said flange.

9. A cable holding assembly as set forth in claim 1 wherein said conduit means includes a hollow line connected to a nipple provided on a suction side of a blower housing of the vacuum cleaner.

10. A cable holding assembly as set forth in claim 1 wherein said conduit means includes a hollow line connected to a dust chamber of the vacuum cleaner.

11. A cable holding assembly as set forth in claim 1 wherein said conduit means includes a hollow line in the form of a tube molded to said supporting wall.

12. In a vacuum cleaner, a cable holding assembly for supporting an electrical cable in a wound configuration, said assembly comprising:

a supporting wall in the vacuum cleaner, said supporting wall being formed with a cup-shaped indentation;

a bearing pin rigid with said indentation and projecting substantially perpendicularly therefrom, said bearing pin having a diameter smaller than an outside diameter of said indentation so that said indentation has at one end a transversely oriented annular surface surrounding an end of said bearing pin;

a cable drum having a pair of sidewalls attached to a hollow hub and an annular flange extending axially from beyond one of said sidewalls, said hub defining a cavity, said pin extending axially into said cavity, said flange engaging an outer surface of said indentation to form a support bearing therewith for said drum, said hub being provided with radial openings, said annular surface being provided with an aperture communicating with said openings via said cavity, said hub being provided on a radially inner side at an end opposite said flange with an inwardly projecting annular bearing shoulder engaging said pin, said shoulder and said pin cooperating to form another support bearing for said drum; and conduit means in the vacuum cleaner for connecting said aperture to a suction space of the vacuum cleaner.

13. A cable holding assembly as set forth in claim 12 wherein said conduit means includes a hollow line in the form of a tube molded to said supporting wall.

* * * * *